US011098734B2

(12) United States Patent
Nakashima et al.

(10) Patent No.: US 11,098,734 B2
(45) Date of Patent: Aug. 24, 2021

(54) PROPELLER FAN, AIR-CONDITIONING APPARATUS AND VENTILATOR

(71) Applicant: Mitsubishi Electric Corporation, Tokyo (JP)

(72) Inventors: Seiji Nakashima, Tokyo (JP); Takuya Teramoto, Tokyo (JP); Katsuyuki Yamamoto, Tokyo (JP); Yusuke Adachi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 16/437,190

(22) Filed: Jun. 11, 2019

(65) Prior Publication Data

US 2019/0293091 A1 Sep. 26, 2019

Related U.S. Application Data

(63) Continuation of application No. 16/072,210, filed as application No. PCT/JP2016/069670 on Jul. 1, 2016, now Pat. No. 10,508,662.

(51) Int. Cl.
*F04D 29/66* (2006.01)
*F04D 29/38* (2006.01)

(52) U.S. Cl.
CPC ..... *F04D 29/666* (2013.01); *F04D 29/384* (2013.01); *F04D 29/388* (2013.01); (Continued)

(58) Field of Classification Search
CPC .... F04D 29/384; F04D 29/388; F04D 29/666; F04D 29/667; F04D 29/668; F04D 29/663
See application file for complete search history.

(56) References Cited

U.S. PATENT DOCUMENTS 4,089,618 A * 5/1978 Patel ..... F04D 29/668 416/228
5,603,607 A 2/1997 Kondo et al.
(Continued)

FOREIGN PATENT DOCUMENTS

CN 102 588 337 A 7/2012
CN 102 588 339 A 7/2012
(Continued)

OTHER PUBLICATIONS

International Search Report of the International Searching Authority dated Sep. 20, 2016 issued in corresponding International Patent Application No. PCT/JP2016/069670 (and English translation).
(Continued)

*Primary Examiner* — Justin D Seabe
*Assistant Examiner* — Christopher R Legendre
(74) *Attorney, Agent, or Firm* — Posz Law Group, PLC

(57) ABSTRACT

A propeller fan includes a boss on a rotation axis, and a blade at an outer circumferential portion of the boss. The blade includes a leading edge and a trailing edge. The blade includes a first area, a first sub-area located inward of the first area, and a second sub-area located outward of the first area. The first area includes a notch formed in the trailing edge. Each of the first sub-area and the second sub-area include plural notches formed in the trailing edge. The notch in the first area is larger than each of the plural notches in each of the first sub-area and the second sub-area.

8 Claims, 5 Drawing Sheets

(52) U.S. Cl.
CPC ..... *F04D 29/663* (2013.01); *F04D 29/667* (2013.01); *F04D 29/668* (2013.01); *F05D 2240/304* (2013.01)

(56) References Cited

U.S. PATENT DOCUMENTS

| | | | | |
|---|---|---|---|---|
| 8,915,717 | B2 * | 12/2014 | Stephan | F04D 29/384 416/189 |
| 10,400,604 | B2 * | 9/2019 | Sawada | F01D 5/16 |
| 10,508,662 | B2 * | 12/2019 | Nakashima | F04D 29/661 |
| 10,578,320 | B2 * | 3/2020 | Sawada | F04D 29/181 |
| 2007/0201982 | A1 | 8/2007 | Neumeier | |
| 2009/0013532 | A1 | 1/2009 | Wood et al. | |
| 2011/0305579 | A1 | 12/2011 | Wood et al. | |
| 2014/0086754 | A1 | 3/2014 | Seiji et al. | |
| 2015/0152875 | A1 | 6/2015 | Kamiya et al. | |
| 2018/0087784 | A1 * | 3/2018 | Sawada | F04D 29/181 |
| 2019/0120253 | A1 * | 4/2019 | Nakashima | F04D 29/388 |
| 2019/0293091 | A1 * | 9/2019 | Nakashima | F04D 29/667 |

FOREIGN PATENT DOCUMENTS

| | | | | |
|---|---|---|---|---|
| CN | 104 061 187 | A | 9/2014 | |
| JP | H02-061400 | A | 3/1990 | |
| JP | H08-189497 | A | 7/1996 | |
| JP | 2001-073995 | A | 3/2001 | |
| JP | 2003-206894 | A | 7/2003 | |
| JP | 4132826 | B2 * | 8/2008 | F04D 29/384 |
| JP | 2009-013984 | A | 1/2009 | |
| JP | 2013-136973 | A | 7/2013 | |
| JP | 2013-249762 | A | 12/2013 | |
| JP | 2014-105600 | A | 6/2014 | |
| WO | WO-2018179075 | A1 * | 10/2018 | B63H 1/26 |

OTHER PUBLICATIONS

Extended European Search Report dated Apr. 25, 2019 issued in corresponding EP patent application No. 16907353.3.

Extended European Search Report dated May 15, 2019 issued in corresponding EP patent application No. 18186491.9.

Decision to Grant a Patent dated Oct. 16, 2018 issued in corresponding JP patent application No. 2018-106791 and English translation).

Office Action dated Mar. 28, 2019 issued in corresponding JP patent application No. 2018-524707 (and English translation).

Office Action dated Jun. 20, 2019 issued in corresponding AU patent application No. 2016412490.

* cited by examiner

PROPELLER FAN, AIR-CONDITIONING APPARATUS AND VENTILATOR

CROSS REFERENCE TO RELATED APPLICATIONS

This application is a continuation application of U.S. utility application Ser. No. 16/072,210 filed on Jul. 24, 2018, which is a U.S. national stage application of PCT/JP2016/069670 filed on Jul. 1, 2016, the contents of which are incorporated herein by reference.

TECHNICAL FIELD

The present invention relates to a propeller fan which is provided with blades including notches formed in trailing edges of the blades.

BACKGROUND ART

Patent literature 1 describes a propeller fan including a plurality of vanes. In the propeller fan, each of the vanes includes a trailing edge into which serrations are cut. Thereby, wind at a suction surface of each vane and wind at a pressure surface thereof gradually join each other, and the velocity loss in the vicinity of the trailing edge is therefore small. As a result, the velocity gradient is reduced as compared with those of conventional propeller fans, thus reducing the frequency of occurrence of turbulence, and also reducing noise.

CITATION LIST

Patent Literature

Patent Literature 1: Japanese Unexamined Patent Application Publication No. 8-189497

SUMMARY OF INVENTION

Technical Problem

However, in the propeller fan described in patent literature 1, the pitch and the widths of the serrations are determined without sufficiently considering the difference between flow areas of the vane which are located at different positions in the radial direction. Thus, it is not possible to reduce the maximum wind velocity or divide an eddy, which is a source of noise. Therefore, it is not possible to sufficiently reduce noise.

The present invention was made to solve the above problems, and an object of the invention is to provide a propeller fan which can more greatly reduce noise.

Solution to Problem

A propeller fan according to an embodiment of the present invention includes a boss provided on a rotation axis and a blade provided on an outer circumferential portion of the boss. The blade includes a leading edge and a trailing edge. The blade includes a first area, a second area located inward of the first area, and third areas located outward of the second area. The third areas are located inward and outward of the first area, with the first area interposed between the third areas. Each of the first area, the second area and the third areas includes at least one notch formed in the trailing edge. The notches satisfy the relationship "P1>P2>P3", where P1 is the width of the at least one notch in the first area, P2 is the width of the at least one notch in the second area, and P3 is the width of the at least one notch in each of the third areas.

Advantageous Effects of Invention

According to an embodiment of the present invention, each of the notches at the trailing edge of the blade has a width determined in accordance with its position in the radial direction of the propeller fan. Thereby, noise made by the propeller fan can be more greatly reduced.

DESCRIPTION OF EMBODIMENTS

Embodiment 1

Figure 1:
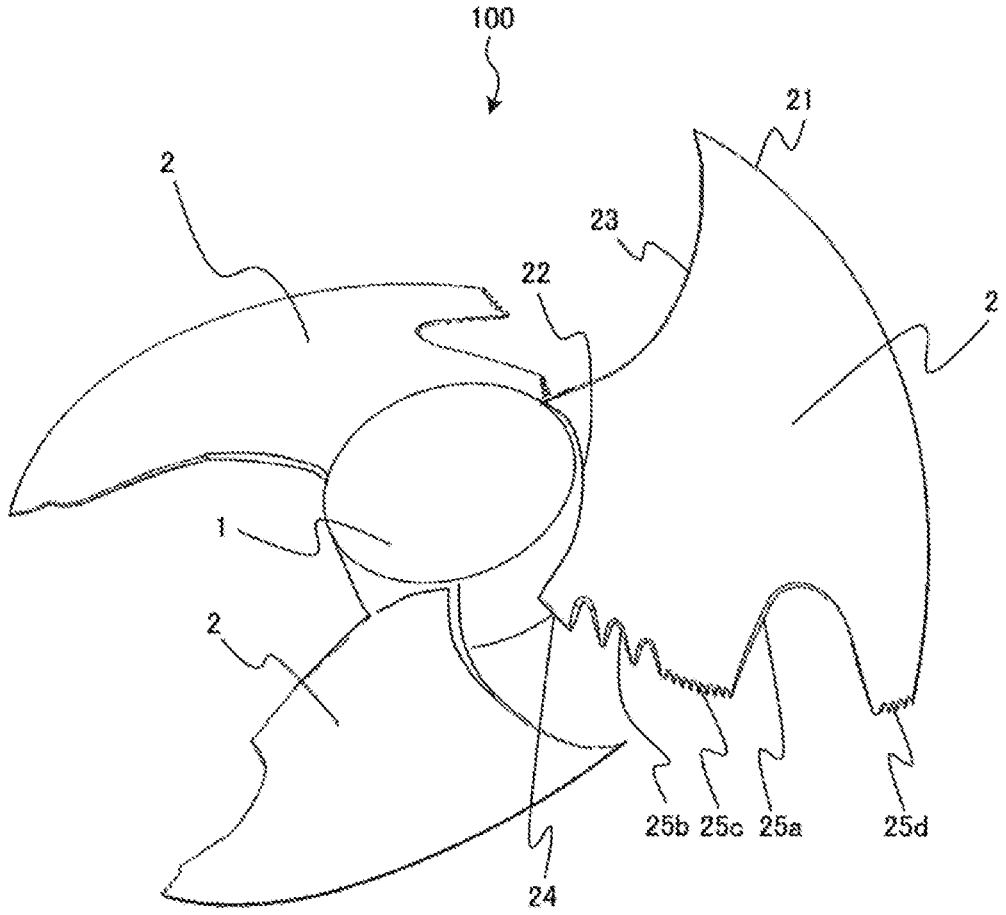
FIG. 1 is a perspective view schematically illustrating a configuration of a propeller fan 100 according to embodiment 1 of the invention.
Figure 2:
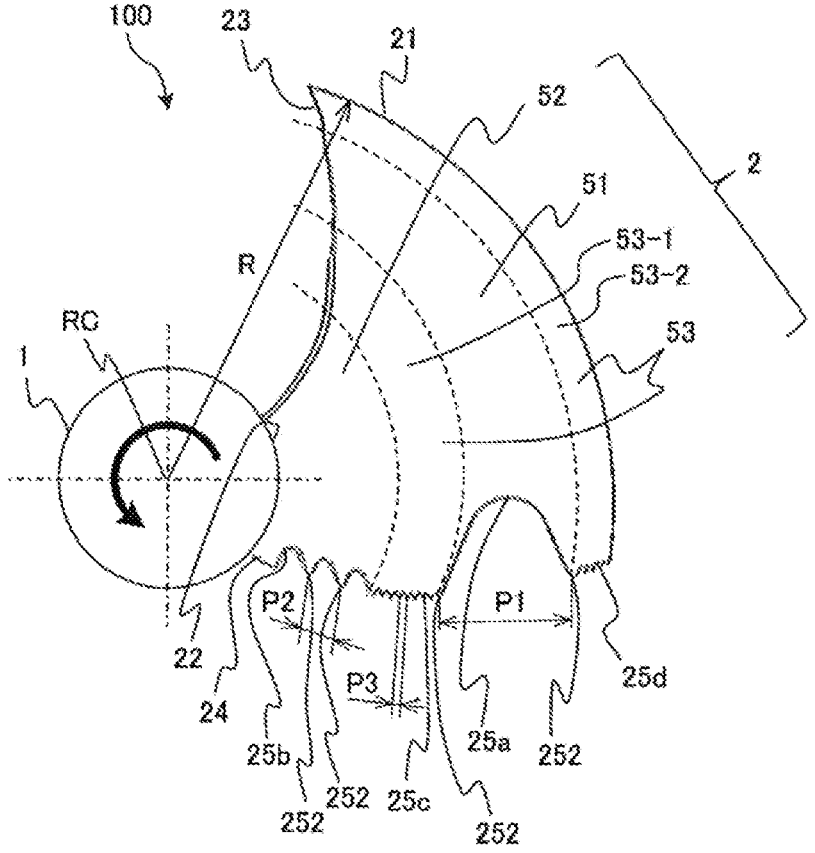
FIG. 2 is a front view illustrating a configuration of a boss 1 and one of blades 2 of the propeller fan 100 according to embodiment 1 of the invention.

A propeller fan according to embodiment 1 of the present invention will be described. FIG. 1 is a perspective view schematically illustrating a configuration of a propeller fan 100 according to embodiment 1. FIG. 2 is a front view illustrating a configuration of a boss 1 and one of blades 2 of the propeller fan 100 according to embodiment 1. The propeller fan 100 is used in, for example, an air-conditioning apparatus or a ventilator. In figures referred to below, which include FIGS. 1 and 2, for example, the relative dimensions of structural elements or the shapes thereof may differ from those of an actual propeller fan.

As illustrated in FIGS. 1 and 2, the propeller fan 100 includes a boss 1 and a plurality of blades 2 (one of which is illustrated in FIG. 2) provided at an outer circumferential portion of the boss 1. The boss 1 is located on a rotation axis RC of the propeller fan 100. The boss 1 is rotated about the rotation axis RC by a driving force of a motor (not illustrated) in a rotation direction indicated by a bold arrow in FIG. 2. The blades 2 are arranged at regular intervals, for example, in a circumferential direction. The blades 2 have, for example, the same configuration. Referring to FIG. 1, the number of blades 2 is three, but it is not limited to three.

Each of the blades 2 has a leading edge 23, a trailing edge 24, an outer circumferential edge 21 and an inner circumferential edge 22. The leading edge 23 is an edge which is located at a front portion of the blade 2 when the boss 1 and the blade 2 are rotated. The trailing edge 24 is an edge which is located at a rear portion of the blade 2 when the boss 1 and the blade 2 are rotated. The outer circumferential edge 21 is an edge which is located on an outer circumferential side of the blade 2 and extends between an outer peripheral end of the leading edge 23 and an outer peripheral end of the trailing edge 24. The inner circumferential edge 22 is an edge which is located on an inner circumferential side of the blade 2, and extends between an inner peripheral end of the leading edge 23 and an inner peripheral end of the trailing edge 24. The inner circumferential edge 22 is connected to an outer circumferential surface of the boss 1.

The blade 2 has a first area 51, a second area 52 and third areas 53 arranged in a radial direction of the propeller fan 100 (which may be hereinafter simply referred to as "radial direction"). The first area 51 is located relatively close to the outer circumferential side of the blade 2. For example, the first area 51 is located outward of an intermediate portion between the outer circumferential edge 21 and the inner circumferential edge 22, that is, an intermediate portion of the blade 2 in the radial direction. The second area 52 is located inward of the first area 51. The third areas 53 are located outward of the second area 52, and are located inward and outward of the first area 51, with the first area 51 interposed between the third areas 53. To be more specific, the third areas 53 include a first sub-area 53-1 located outward of the first area 52 and inward of the second area 51, and a second sub-area 53-2 located outward of the first area 51. The first sub-area 53-1 is adjacent to an outer circumferential side of the second area 52 and an inner circumferential side of the first area 51. The second sub-area 53-2 is adjacent to an outer circumferential side of the first area 51. The first area 51, the second area 52, and the first sub-area 53-1 and second sub-area 53-2 of the blade 2 extend in the circumferential direction of the propeller fan 100.

In the trailing edge 24 of the blade 2, a plurality of notches are formed. To be more specific, each of the first area 51, the second area 52 and the third areas 53 includes at least one notch formed in the trailing edge 24. As described later, the notches of the first area 51, the second area 52 and the third areas 53 are different from each other in size (at least in width). The notches are each formed in the shape of a triangle having a rounded root portion. Between any adjacent two of the notches, a crest portion 252 is formed. The width of each of the notches is defined as the distance between adjacent two crest portions 252 located on the both sides of each notch. The depth of each notch is defined as the distance between the root portion of thereof and a straight line connecting the adjacent two crest portions 252 located on the both sides of each notch. In embodiment 1, all the notches are the same as each other in ratio between width and depth. All the notches may be similar to each other in shape. Furthermore, in embodiment 1, the notches are continuously formed along the trailing edge 24.

The first area 51 includes a single notch 25*a* formed in the trailing edge 24. The second area 52 includes a plurality of notches 25*b* formed in the trailing edge 24. For example, all the notches 25*b* are formed to have the same width. Since the notches 25*b* are continuously formed along the trailing edge 24, the pitch at which corresponding points on the notches 25*b* are located is equal to the width of each of the notches 25*b*. In the third areas 53, the first sub-area 53-1 includes a plurality of notches 25*c* formed in the trailing edge 24; and the second sub-area 53-2 includes a plurality of notches 25*d* formed in the trailing edge 24. For example, all the notches 25*c* and the notches 25*d* are formed to have the same width. Since the notches 25*c* are continuously formed along the trailing edge 24, the pitch at which corresponding points on the notches 25*c* are located is equal to the width of each of the notches 25*c*. Furthermore, since the notches 25*d* are continuously formed along the trailing edge 24, the pitch at which corresponding points on the notches 25*d* are located is equal to the width of each of the notches 25*d*. The above notches satisfy the relationship "P1>P2 >P3", where P1 is the width of the notch 25*a*, P2 is the width of each of the notches 25*b*, and P3 is the width of each of the notches 25*c* and 25*d*.

In embodiment 1, P1 is 0.32R, P2 is 0.072R, and P3 is 0.019R, where R is the distance between the rotation axis RC and the outer circumferential edge 21, that is, R is the radius of the outer circumferential edge 21. However, P1, P2 and P3 are not limited to the above values.

Furthermore, in embodiment 1, the relationship "n1<n2<n3" is satisfied, where n1 is the number of notches 25*a* in the first area 51, n2 is the number of notches 25*b* in the second area 52, and n3 is the total number of notches 25*c* and 25*d* in the third areas 53.

As described above, the propeller fan 100 according to embodiment 1 includes the boss 1 provided on the rotation axis RC and the blades 2 which are located at the outer circumferential portion of the boss 1, and each of which includes the leading edge 23 and the trailing edge 24. Each blade 2 has the first area 51, the second area 52 located inward of the first area 51, and the third areas 53 which are located outward of the second area 52, and which are also located inward and outward of the first area 51, with the first area 51 interposed between the third areas 53. Each of the first area 51, the second area 52 and the third areas 53 includes at least one notch formed in the trailing edge 24. The above notches satisfy the relationship "P1>P2>P3", where P1 is the width of the notch 25*a* in the first area 51, P2 is the width of the notch 25*b* in the second area 52, and P3 is the width of each of the notches 25*c* and 25*d* in the third areas 53.

Figure 3:
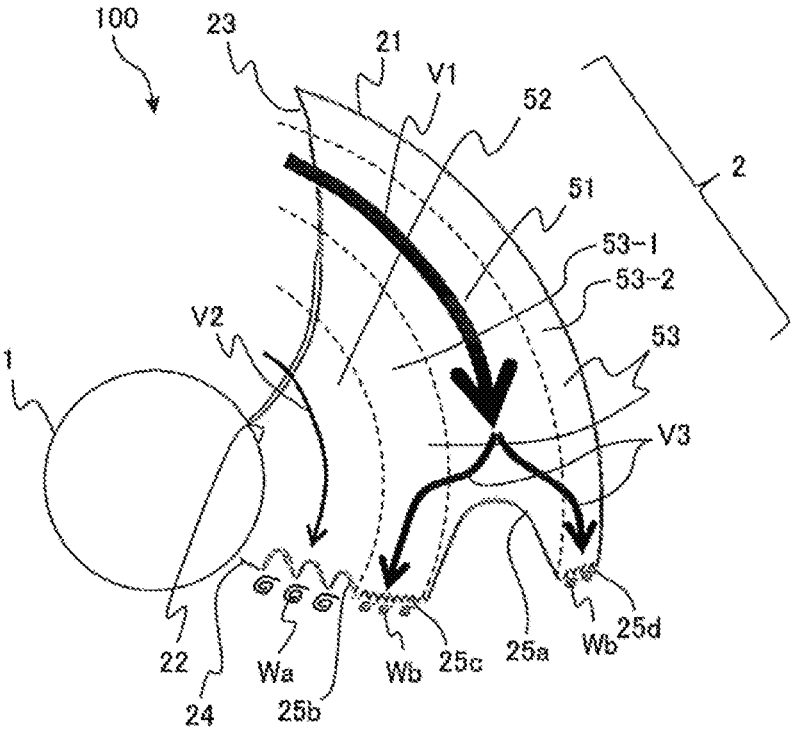
FIG. 3 is a view illustrating an example of winds at the propeller fan 100 according to embodiment 1 of the invention.

The advantages obtained by the propeller fan 100 according to embodiment 1 will be described with reference to FIG. 3. FIG. 3 is a view illustrating an example of the winds at the propeller fan 100 according to embodiment 1, and corresponds to FIG. 2. As illustrated in FIG. 3, since the first area 51 is located on the outer circumferential side of the blade 2, the moving velocity of the first area 51 of the blade 2 is relatively high. Thus, at the surface of the blade 2, the velocity V1 of wind at the first area 51 is, for example, the maximum wind velocity. Part of the trailing edge 24 which is located in the first area 51 includes a large notch, that is, the notch 25*a* having a width P1. By virtue of this configuration, the wind having the velocity V1 can be roughly divided into wind which flows to the first sub-area 53-1 located on the inner circumferential side and wind which flows to the second sub-area 53-2 located on the outer circumferential side. It is therefore possible to reduce the velocity of wind passing the trailing edge 24, which greatly contributes to generation of noise.

The second area 52 is located inward of the first area 51. Thus, when the blade 2 is moved, the moving velocity of the second area 52 is lower than that of the first area 51. Therefore, at the surface of the blade 2, the velocity V2 of wind at the second area 52 is lower than the velocity V1. Thus, at the second area 52, a trailing-edge eddy Wa which is generated from the trailing edge 24 when the wind passes the trailing edge 24 is a dominant source of noise. Part of the trailing edge 24 which is located in the second area 52 includes the notches 25*b* each having the width P2, which is smaller than that of the notch 25*a* in the first area 51, and can thus divide the trailing-edge eddy Wa, which is a smaller stream phenomenon than that generated at the first area 51.

At the third areas 53, divided winds separated by the notch 25*a* in the first area 51 flow while having a velocity V3. Since they are winds into which the wind having the velocity V1 is divided, the velocity V3 is lower than the velocity V1. Furthermore, since the third areas 53 are located outward of the second area 52, the velocity V3 is higher than the velocity V2. That is, the relationship between the velocities V1, V2 and V3 satisfies V1>V3>V2. Also, at the third areas 53, trailing-edge eddies Wb generated from the trailing edge 24 when wind passes the trailing edge 24 are dominant sources of noise. Since the velocity V3 of the wind at each of the third areas 53 is higher than the velocity V2 of the wind at the second area 52, the scale of each of the trailing-edge eddies Wb is far smaller than that of the trailing-edge eddy Wa. Since at the trailing edge 24, the third areas 53 have notches 25*c* and 25*d* each having the width P3, which is smaller than that of the notch 25*b* in the second area 52, they can divide trailing-edge eddies Wb, which are smaller in scale than that in the second area 52.

As described above, in embodiment 1, the widths of the notches 25*a*, 25*b*, 25*c*, and 25*d* formed in the trailing edge 24 of the blade 2 are appropriately determined in accordance with the positions of these notches in the radial direction. It is therefore possible to more greatly reduce noise generated by the propeller fan 100, and also further reduce the power input to the propeller fan 100.

Embodiment 2

Figure 4:
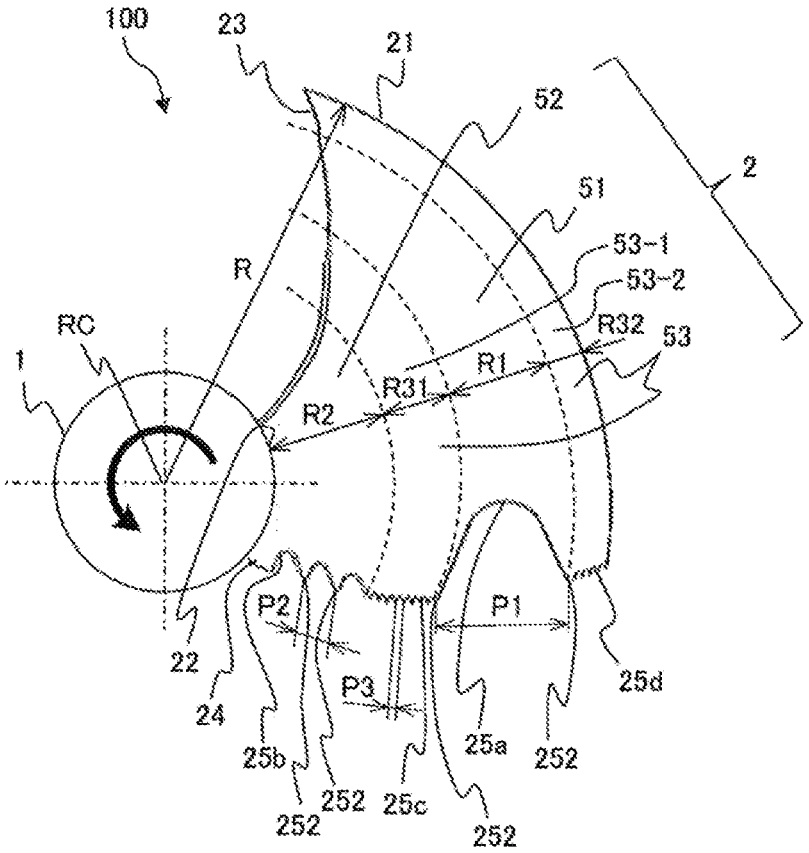
FIG. 4 is a front view illustrating a configuration of a boss 1 and one of blades 2 of a propeller fan 100 according to embodiment 2 of the invention.

A propeller fan according to embodiment 2 of the present invention will be described. FIG. 4 is a front view illustrating a configuration of the boss 1 and one of the blade 2 of the propeller fan 100 according to embodiment 2. With respect to embodiment 2, structural elements having the same functions and operations as those in embodiment 1 will be denoted by the same reference signs as in embodiment 1, and their explanations will thus be omitted.

As illustrated in FIG. 4, the widths of the first area 51, the second area 52, the first sub-area 53-1 and the second sub-area 53-2 in the radial direction are R1, R2, R31, and R32, respectively. The total width of the third areas 53 in the radial direction is the sum of the width R31 of the first sub-area 53-1 and the width R32 of the second sub-area 53-2. In embodiment 2, the total of the widths R31 and R32 of the third areas 53 is equal to the width R1 of the first area 51 (R31+R32=R1). In the present specification, the word "equal" covers not only "exactly equal" but "substantially equal" in the case where things can be considered substantially equal to each other in view of common knowledge in technique.

The advantages obtained by the propeller fan 100 according to embodiment 2 will be described. As illustrated in FIG. 3, the winds at the third areas 53 are divided winds separated by the notch 25*a* in the first area 51. In embodiment 2, since the total of the widths R31 and R32 of the third areas 53 is equal to the width R1 of the first area 51, the width of wind not yet divided and the width of divided winds can be made equal to each other. Thus, the trailing-edge eddies Wb generated at the third areas 53 can be further effectively divided, and noise generated by the propeller fan 100 can thus be further reduced.

In embodiment 2, although the total of the widths R31 and R32 of the third areas 53 is equal to the width R1 of the first area 51, even if the total of the widths R31 and R32 of the third areas 53 is set greater than the width R1 of the first area 51 (R31+R32 >R1), the same advantage as described above can be obtained.

Embodiment 3

Figure 5:
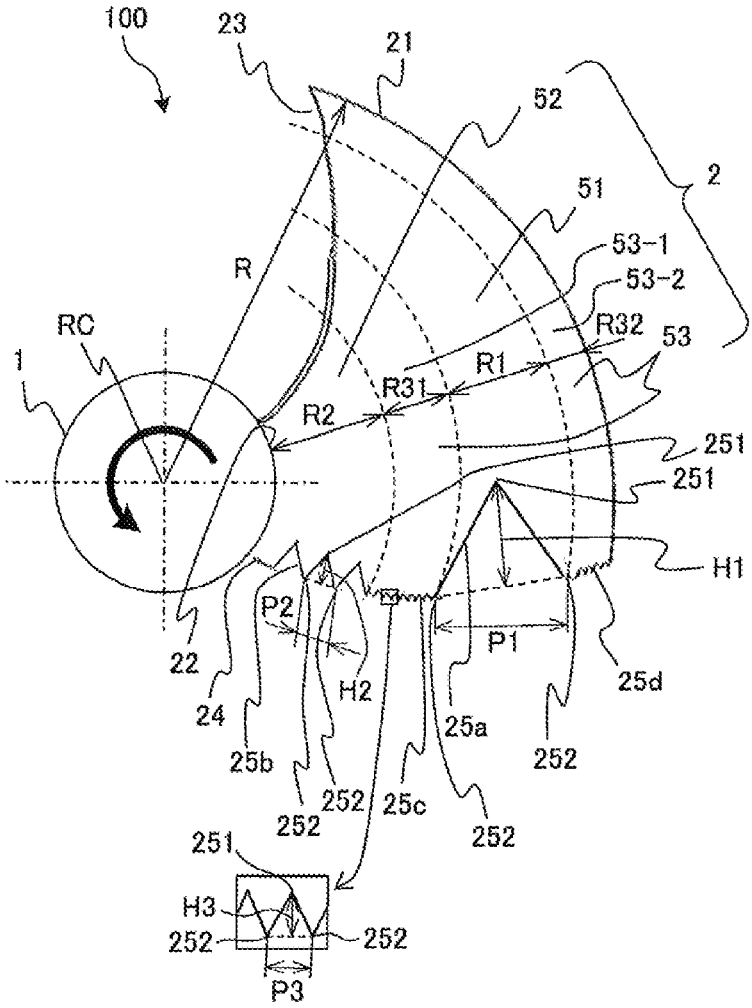
FIG. 5 is a front view illustrating a configuration of a boss 1 and one of blades 2 of a propeller fan 100 according to embodiment 3 of the invention.

A propeller fan according to embodiment 3 of the invention will be described. FIG. 5 is a front view illustrating a configuration of the boss 1 and one of the blades 2 of the propeller fan 100 according to embodiment 3. With respect to embodiment 3, structural elements having the same functions and operations as those of embodiment 1 will be denoted by the same reference signs as in embodiment 1, and their descriptions will thus be omitted.

As illustrated in FIG. 5, in embodiment 3, notches 25*a*, 25*b*, 25*c* and 25*d* are all triangularly formed. Thereby, a root portion 251 of each of the notches 25*a*, 25*b*, 25*c*, and 25*d* has an acute angle.

In the first area 51, since the root portion 251 of the notch 25*a* has an acute angle, wind having the velocity V1 can be effectively divided into wind flows to the first sub-area 53-1 located on the inner circumferential side and wind which flows to the second sub-area 53-2 located on the outer circumferential side. As a result, the velocity of wind passing the trailing edge 24, which greatly contributes to generation of noise, can be further reduced. In the second area 52 and the third areas 53, the root portions 251 of the notches 25*b*, 25*c* and 25*d* have an acute angle, and the trailing-edge eddies Wa and Wb can thus be effectively disposed. It is therefore possible to further greatly reduce noise generated by the propeller fan 100.

Embodiment 4

A propeller fan according to embodiment 4 of the invention will be described with reference to FIG. 5 referred to above. In embodiment 4, the width and the depth of each of the notches are equal to each other. Specifically, the width P1 and depth H1 of the notch 25*a* are equal to each other (P1=H1), the width P2 and depth H2 of the notch 25*b* are equal to each other (P2=H2), and the width P3 and depth H3 of each of the notches 25*c* and 25*d* are equal to each other (P3=H3). As described above, the depth of each of the notches is defined as a distance between a straight line connecting two crest portions 252 located on both sides of each notch and the root portion 251 thereof. In this specification, the term "equal" covers not only "exactly equal" but "substantially equal" in the case where things can be considered substantially equal to each other in view of common knowledge in technique.

By virtue of the above configuration, in the first area 51, the angle of the root portion 251 of the notch 25*a* is set to enable the notch 25*a* to most effectively divide wind having the wind velocity V1 into wind which flows to the first sub-area 53-1 located on the inner circumferential side and wind which flows to the second sub-area 53-2 located on the outer circumferential side. It is therefore possible to further greatly reduce the velocity of wind passing the trailing edge 24, which greatly contributes to generation of noise. In the second area 52 and the third areas 53, the angles of the root portions 251 of the notches 25*b*, 25*c* and 25*d* are set to enable the notches 25*b*, 25*c* and 25*d* to most effectively divide the trailing-edge eddies Wa and Wb. It is therefore possible to further greatly reduce noise of the propeller fan 100.

The above embodiments can be put to practical use in combination.

Reference Signs List

| | |
|---|---|
| 1 | boss |
| 2 | blade |
| 21 | outer circumferential edge |
| 22 | inner circumferential edge |

-continued

| Reference Signs List | |
|---|---|
| 23 | leading edge |
| 24 | trailing edge |
| 25a, 25b, 25c, 25d | notch |
| 51 | first area |
| 52 | second area |
| 53 | third area |
| 53-1 | first sub-area |
| 53-2 | second sub-area |
| 100 | propeller fan |
| 251 | root portion |
| 252 | crest portion |
| RC | rotation axis |
| Wa, Wb | trailing-edge eddy |

The invention claimed is:

1. A propeller fan comprising:

a boss provided on a rotation axis; and a blade provided at an outer circumferential portion of the boss, the blade including a leading edge and a trailing edge, the blade including a first area, a first sub-area located inward of the first area and a second sub-area located outward of the first area, the first area including a single notch formed in the trailing edge, each of the first sub-area and the second sub-area including plural notches continuously formed in the trailing edge, the single notch in the first area extends from an outward-most notch of the plural notches of the first sub-area to an inward-most notch of the plural notches of the second sub-area and divides wind flowing over the first area into lower velocity wind which flows over the first sub-area and the second sub-area in the trailing edge, the single notch in the first area being larger than each of the plural notches in each of the first sub-area and the second sub-area, each of the plural notches of the first sub-area have a same first width, and each of the plural notches of the second sub-area have a same second width, wherein width is defined as a distance between adjacent crest portions located on both sides of the respective notch, wherein the single notch in the first area has a third width which is greater than the first width of each of the plural notches in the first sub-area and the second width of each of the plural notches in the second sub-area, further comprising a second area formed inward of the first sub-area, the second area including plural notches continuously formed in the trailing edge, an outward-most notch of the plural notches of the second area extends to an inward-most notch of the plural notches of the first sub-area, the plural notches of the second area have a same fourth width which is greater than the first width and the second width and smaller than the third width, and a relationship between velocities V1, V2 and V3 satisfies V1>V3>V2, where V1 is velocity of wind at a surface of the blade which flows toward the single notch, V2 is velocity of wind which flows over the second area in the trailing edge, V3 is velocity of wind which flows over the first sub-area and the second sub-area in the trailing edge after the wind having velocity V1 is divided by the single notch.

2. The propeller fan of claim 1, wherein the single notch in the first area has a depth which is greater than a depth of each of the plural notches in each of the first sub-area and the second sub-area.

3. The propeller fan of claim 1, wherein a sum of a first width of the first sub-area in a radial direction of the propeller fan and a second width of the second sub-area in the radial direction is greater than or equal to a third width of the first area in the radial direction.

4. The propeller fan of claim 1, wherein the first area is located outward of an intermediate portion of the blade in a radial direction of the propeller fan.

5. The propeller fan of claim 1, wherein the single notch in the first area, the plural notches in the first sub-area and the plural notches in the second sub-area are continuously formed along the trailing edge.

6. The propeller fan of claim 1, wherein a pitch at which corresponding points on the plural notches of the first sub-area are located is equal to the first width of each of the plural notches of the first sub-area, a pitch at which corresponding points on the plural notches of the second sub-area are located is equal to the second width of each of the plural notches of the second sub-area.

7. An air-conditioning apparatus comprising the propeller fan of claim 1.

8. A ventilator comprising the propeller fan of claim 1.

* * * * *